US011671776B2

(12) United States Patent
Schuster

(10) Patent No.: US 11,671,776 B2
(45) Date of Patent: Jun. 6, 2023

(54) MICROPHONE TEST MODULE AND A METHOD OF TESTING MICROPHONES

(71) Applicant: Cohu GmbH, Kolbermoor (DE)

(72) Inventor: Anton Schuster, Grassau (DE)

(73) Assignee: Cohu GmbH, Kolbermoor (DE)

( * ) Notice: Subject to any disclaimer, the term of this patent is extended or adjusted under 35 U.S.C. 154(b) by 0 days.

(21) Appl. No.: 17/319,626

(22) Filed: May 13, 2021

(65) Prior Publication Data

US 2021/0360360 A1 Nov. 18, 2021

(30) Foreign Application Priority Data

May 14, 2020 (DE) ..... 102020113165.8

(51) Int. Cl.
*H04R 29/00* (2006.01)

(52) U.S. Cl.
CPC ..... *H04R 29/004* (2013.01)

(58) Field of Classification Search
CPC ..... H04R 29/004
USPC ..... 381/58
See application file for complete search history.

(56) References Cited

U.S. PATENT DOCUMENTS

| | | | | |
|---|---|---|---|---|
| 5,146,780 | A | 9/1992 | Zuckerwar et al. | |
| 9,560,462 | B2 | 1/2017 | Eriksen et al. | |
| 9,992,592 | B1 * | 6/2018 | Alam | H04R 29/001 |
| 2010/0290634 | A1 * | 11/2010 | Schaule | H04R 29/004 381/58 |
| 2014/0328489 | A1 * | 11/2014 | Ziegler | H04R 29/004 381/58 |
| 2015/0117654 | A1 * | 4/2015 | John | H04R 29/004 381/59 |
| 2018/0213340 | A1 | 7/2018 | Perrin et al. | |
| 2019/0045284 | A1 * | 2/2019 | Fallon | H04R 3/04 |
| 2019/0346336 | A1 * | 11/2019 | Regef | G01N 15/082 |
| 2021/0120352 | A1 * | 4/2021 | Khenkin | H04R 29/004 |

FOREIGN PATENT DOCUMENTS

| | | |
|---|---|---|
| CN | 102711029 | 10/2012 |
| CN | 106124025 | 11/2016 |
| CN | 107205206 | 9/2017 |
| CN | 109391893 | 2/2019 |
| CN | 109672969 | 4/2019 |
| DE | 10 2008 015 916 A1 | 8/2009 |
| DE | 10 2018 102 096 A1 | 8/2019 |

OTHER PUBLICATIONS

Philippines Notice of Publication on Filipino Application No. 1-2021-050211 dated Jan. 24, 2022.

* cited by examiner

*Primary Examiner* — Daniel R Sellers
(74) *Attorney, Agent, or Firm* — Foley & Lardner LLP

(57) ABSTRACT

A test module for testing microphones comprises an outer chamber being airtight, and a sound chamber comprising an electrical test device for testing the microphones. The sound chamber is located within the outer chamber, and the sound chamber is coupled to the outer chamber with a connection suppressing structure-borne noise between the outer chamber and the sound chamber. A space between the outer chamber and the sound chamber has a gas pressure being lower than an ambient air pressure. A method of testing microphones comprises evacuating the space between the outer chamber and the sound chamber to having a lower gas pressure than an ambient air pressure, and testing the microphone.

14 Claims, 5 Drawing Sheets

MICROPHONE TEST MODULE AND A METHOD OF TESTING MICROPHONES

This application claims the benefit of the filing date of the German Patent Application No. 10 2020 113 165.8 filed 14 May 2020, the disclosure of which is hereby incorporated herein by reference.

TECHNICAL FIELD

An embodiment of the invention relates to a microphone test module for testing a microphone. Further, an embodiment of the invention relates to a method of testing microphones.

TECHNOLOGICAL BACKGROUND

Mobile devices, such as mobile phones, have continuously increased their overall capabilities. The miniaturization of microphones has been critical to the development of mobile phones. So called "MEMS microphones" are small and face a desire of mobile phone users to get better sound quality. In particular, with an increasing bandwidth being available this demand seems reasonable.

SUMMARY

There may be a need to amend a test of microphones, in particular, of MEMS microphones used in mobile devices.

According to an embodiment, a microphone test module for testing microphones, and a method of testing microphones are provided according to independent claims is provided.

According to an embodiment of the invention a microphone test module for testing microphones comprises:

an outer chamber being airtight, and a sound chamber comprising an electrical test device for testing the microphone, wherein the sound chamber is located within the outer chamber, and wherein the sound chamber is coupled to the outer chamber with a connection suppressing structure-borne noise between the outer chamber and the sound chamber, and wherein a space between the outer chamber and the sound chamber has a gas pressure being lower than an ambient air pressure.

According to an embodiment of the invention a method of testing microphones comprises:

providing an outer chamber being airtight, and providing a sound chamber comprising an electrical test device for testing the microphone, wherein the sound chamber is located within the outer chamber, and wherein the sound chamber is coupled to the outer chamber with a connection suppressing structure-borne noise between the outer chamber and the sound chamber, and evacuating a space between the outer chamber and the sound chamber to having a lower gas pressure than an ambient air pressure, and testing the microphone.

The term "microphone" may refer to an instrument whereby sound waves are caused to generate or modulate an electric current for the purpose of transmitting or recording sound (as speech or music).

The expression "test module" may refer to a unit of measurement or inspection as a basis for evaluation, here in particular, in the area of semiconductor testing.

The expression "microphone test module" may refer to a unit for inspecting and/or evaluating microphones, in particular, so called "MEMS microphones". The term "test" or "testing" may, in particular, include calibrating the MEMS microphone according to specific test frequencies which may vary dependent on the MEMS microphone and depending on electronical properties of the MEMS microphone. Since, the embodiment of the invention is focused on an optimization of the test environment, i.e. the test module, and is not focused on the test in particular, the embodiment is free of information of the actual test itself about which a variety of methods are known and achievable.

The expression "outer chamber" may refer to an artificial cavity being arrange external to something else, so that the outer chamber encloses something.

The expression "sound chamber" may refer to specially designed cavity for testing or recording of noise or sonance. The sound chamber may be airtight to an extent that there is an optimized air pressure within the sound chamber for testing the microphone and that no or not a disturbing amount of air within the sound chamber may escape to the outer chamber during the test.

The expression "electrical test device" may refer to a piece of equipment designed to serve a purpose of performing a special functional test, in particular an electrical test for microphones. The electrical test device may be or comprise a so-called test socket, typically used for semiconductor testing. The electrical test device may be arranged within the sound chamber being closed and may be adapted to apply test signals to the microphone and to transmit data and/or test signals to a tester being located outside of the outer chamber, and outside of the test module, respectively.

The expression "a connection suppressing structure-borne noise" may refer to a coupling of two objects reducing or avoiding noise being normally transmitted by solids. The connection may couple the objects elastically and/or with a magnetic field, so that the coupled object does not touch.

The expression "a space between the outer chamber and the sound chamber" may refer to a solid-free 3-dimensional expansion between the outer and the sound chamber. The space may be regularly filled with air. The space between the outer chamber and the sound chamber may also be called "free space" being free of any solid or object, with an exemption of air or vacuum.

The expression "having gas pressure being lower than an ambient air pressure" may refer to a fluid pressure, in particular air pressure, being less than a typical atmospheric air pressure. The pressure in the space between the outer chamber and the sound chamber, or an inner chamber, respectively, may be lower than 800 mbar, 600 mbar, 400 mbar, 200 mbar, 100 mbar, 50 mbar, 30 mbar, 20 mbar, 10 mbar, 5 mbar, 3 mbar, 2 mbar, 1 mbar, 0.5 mbar, 0.3 mbar, 0.2 mbar, 0.1 mbar, or 0.05 mbar.

A gist is that by evacuating a space surrounding the sound chamber transmission of noise through the air, i.e. airborne sound, may be suppressed. The embodiment is based on the finding in an experimental setup close to the embodiment airborne sound generated in a typical test floor environment may be significantly suppressed. Furthermore, according to the experimental setup close to the embodiment there might still be a significant amount of structure-borne sound left which may also disturb an accuracy of testing and calibrating MEMS microphones. The structure-borne sound, however, may be reduced by hanging and/or supporting the sound chamber elastically in relation to the outer chamber. The hanging and/or supporting may be achieved using an elastic material and/or a magnetic field. For decoupling the airborne noise, it may by applicable to use also combination of the elastic material and/or the magnetic field in combination with non-elastic solids in order to, e.g. filter out low pass noise occurring within the outer chamber and generated in the ambience of the outer chamber. Solid materials may be used within an appropriate design of the whole connection in order to suppress structure borne noise and/or the solid materials may in addition have structure borne noise suppressing properties, as well as blocking air borne noise originating from the outer chamber.

According to an exemplary embodiment of the microphone test module, comprises the outer chamber an outer chamber opening, and an outer chamber door to open and close the outer chamber opening, wherein the outer chamber opening is adapted to receive the microphone to be tested in the open state of the outer chamber, and wherein the outer chamber door airtightly closes the outer chamber opening when testing.

The expression "outer chamber opening" may refer to an aperture or outlet of the outer chamber.

The expression "outer chamber door opens and closes" may refer to a port by which the chamber may let pass something, i.e. "open state" or may avoid passing of something, i.e. "closed state". The outer chamber door may, in particular, open and close the outer chamber opening.

The expression "airtightly close" may refer to a condition of being impermeable to air or nearly impermeable.

An opening being arranged within an outer shell of the outer chamber may be closable by a outer chamber door, which may have any form in order to achieve two states in which the outer chamber opening is open to let microphones and/or a carrier occupied with microphones let pass and in which other state the outer chamber door closes the outer chamber sufficiently so that no ambient air from outside enters the outer chamber. Further, the sound chamber may be sufficiently airtight, so that no or not a disturbing amount of air within the sound chamber may escape from the sound chamber into the interior within the outer chamber during the testing. Otherwise a noise reduction based on the vacuum within the outer chamber may be lost and may harm testing the microphone.

According to an exemplary embodiment of the microphone test module, comprises the connection for suppressing the structure-borne noise a suspension being elastic and/or a support being elastic, wherein the elasticity is achieved by a magnetic field and/or an elastic material.

The expression "a suspension being elastic" may refer to the act of hanging something in a flexible, resilient, or springy way. In particular, the suspension may engage with the object in one point from its top.

The expression "support being elastic" may refer to bear or maintain from the bottom, i.e. from the bottom of the object.

The term "elastic material" may refer to something being capable of being easily stretched or expanded and resuming former shape.

The expression "magnetic field" may refer to any effect caused by magnetism. The magnetic field may exert a force which may be elastically. The magnetic field may be caused by a ferromagnet referring to or relating to substances with an abnormally high magnetic permeability. The magnetic field may be caused by a "diamagnet" referring to having a magnetic permeability less than that of a vacuum, and hence being slightly repelled by a ferromagnet. Further, an electromagnet may exert the force. The term "electromagnet" may refer to a core of magnetic material (such as iron) surrounded by a coil of wire through which an electric current is passed to magnetize the core.

According to an exemplary embodiment the microphone test module further comprises a vacuum pump to evacuate the space within the outer chamber by directly connecting to the outer chamber and/or indirectly by connecting to a vacuum reservoir being connected to the outer chamber via a closed valve, wherein the vacuum pump precedingly evacuates the vacuum reservoir before the valve opens for evacuating the space within the outer chamber.

The expression "vacuum pump" may refer mechanical device for exhausting gas from an enclosed space in order to achieve a specific degree of emptiness of the enclosed space.

The term "valve" may refer to a mechanical device by which the flow of a fluid or gas regulated by a movable part that opens, shuts, or partially obstructs one or more ports or passageways.

The expression "directly connecting to the outer chamber" may in this context refer to coupling to the outer chamber free of a vacuum reservoir being coupled in between.

The expression "precedingly evacuates the vacuum reservoir" may refer to a first point in time which is before a second point in time when the valve opens to let the vacuum reservoir evacuate the space within the outer chamber automatically due to a pressure difference with the vacuum space having a lower pressure than the space within the outer chamber which is airtightly closed.

According to an exemplary embodiment the microphone test module further comprises a supply cable for supply of electrical power and/or data transfer, wherein the supply cable goes airtightly through the outer chamber and connects to the microphone when testing.

The expression "supply cable" may refer to an electrical cable which may comprise multiple filaments for transmitting electrical energy and/or data.

The expression "the supply cable goes airtightly through" may here refer to: The supply cable runs from the outside to the inside of the outer chamber and this still preserves the airtightness of the outer chamber.

The expression "connects to the microphone" may refer to an electrical coupling to the microphone for testing, wherein there is not necessarily direct connection.

In particular, the electronic test device may be connected in between the microphone to the supply cable and hence, and may connect the both.

According to an exemplary embodiment the microphone test module further comprises an inner chamber, wherein the inner chamber is located inside the outer chamber, and wherein the sound chamber is located inside the inner chamber, the inner chamber being airtight when testing, wherein the inner chamber is coupled to the outer chamber with the connection suppressing structure-borne noise between the outer chamber and the inner chamber, so that structure-borne noise is suppressed between the outer chamber and the sound chamber, and wherein a space between inner chamber and the outer chamber has the gas pressure being lower than an ambient air pressure.

The expression "inner chamber" may refer to an artificial cavity being inside of the outer chamber.

According to an exemplary embodiment of the microphone test module, comprises the inner chamber comprises an inner chamber opening, and an inner chamber door to open and close the inner chamber opening, wherein the inner chamber opening is adapted to receive the microphone to be tested in the open state of the inner chamber, and wherein the inner chamber door airtightly closes the inner chamber opening when testing.

The expressions "inner chamber opening", and "inner chamber door" may refer to objects equal to the objects described with the expressions "outer chamber opening", and "outer chamber door".

According to an exemplary embodiment the microphone test module further comprises an airlock between the outer chamber door and the inner chamber door, so that the microphone to be tested may insertable through the outer chamber door and through the inner chamber door into the inner chamber, when the airlock is open, and wherein the inner chamber and the outer chamber are removed from each other, when the airlock is closed. Then, as a consequence, a vacuum pressure V may be established within the space between the outer chamber and the inner chamber.

According to an exemplary embodiment of the microphone test module comprises the sound chamber a first sound chamber half and a second sound chamber half, wherein the first sound chamber half and the second sound chamber half provide a sound chamber opening to receive a microphone to be tested, and wherein the first sound chamber half and the second sound chamber half provide an electrical connection between the microphone to be tested and the test device.

The expression "first sound chamber half" and "second sound chamber half" may refer to two part of not necessarily same shape or size but functionally interacting with each other to form the sound chamber.

The expression "provide an electrical connection between the microphone and the test device" may refer to an interaction of the first sound chamber half and the second sound chamber half producing a condition for an electrical connection between the microphone and the test device. I.e. when the first sound chamber half and the second sound chamber half form the sound chamber there may be simultaneously and automatically an electrical connection formed between the electrical test devices and the microphone.

According to an exemplary embodiment comprises an automated test system for testing microphones a handler and the microphone test module, according to at least one of the described embodiments, wherein the handler is adapted to feed microphones to be tested to the test module.

The term "handler" may refer to a machine for transporting and mechanically and physically conditioning electronic components and an electrical connection, e.g. here MEMS microphones.

The expression "to feed microphones" may refer to move microphones, or microphone chips, or MEMS microphones for a specific purpose, e.g. for directly testing or applying to a carrier or other device for further conveying.

The term "carrier" may refer to tray-like conveyer for transporting electronic components, in particular MEMS microphones.

The term "carrier" may refer to a test carrier which are commonly known and exist in different variations. The carrier, or test carrier, may comprise a plurality of receptacles wherein each single receptacle may receive on microphone, and the test carrier may hold or keep the microphone in the receptacles during a test of the microphones. A type of the test carrier may be vary depending on whether the microphone is of the so-called "port up" or "port down" type, which may specify whether the microphone may be electrically contacted on the same side where the sound port of the microphone is located, or whether the sound port and the electrical contact portions of the microphone are located on different or opposing sides of the microphone or its main planes, respectively.

The expression "carrier for carrying the microphones" may refer to a property of the carrier to safely convey the microphones to the test module and back to a part within a handler, where at the very end the microphones are sorted and ready to transport.

According to an exemplary embodiment, the automated test system further comprises a carrier, for carrying the microphones, wherein the handler feeds the carrier, carrying the microphones to be tested to the test module.

According to an exemplary embodiment the method of testing microphones comprises:

providing the outer chamber with an outer chamber opening having an outer chamber door, and opening the outer chamber door to receive the microphone to be tested in the outer chamber, closing the outer chamber door airtightly when testing the received microphone.

According to an exemplary embodiment of the method of testing microphones comprises:

providing a vacuum pump to evacuate the space within the outer chamber by directly connecting the vacuum pump to the outer chamber and evacuating the space within the outer chamber by using the vacuum pump and/or providing a vacuum pump to evacuate the space within the outer chamber indirectly by connecting the vacuum pump to a vacuum reservoir being connected to the outer chamber via a closed valve, and evacuating the vacuum reservoir using the vacuum pump to generate a vacuum in the vacuum reservoir, and opening the valve to evacuate the space within the outer chamber with the generated vacuum.

According to an exemplary embodiment the method of testing microphones comprises: providing an inner chamber being airtight, wherein the inner chamber is located inside the outer chamber, and wherein the sound chamber is located inside the inner chamber, wherein the inner chamber is coupled to the outer chamber with the connection suppressing structure-borne noise between the outer chamber and the inner chamber, so that structure-borne noise is suppressed between the outer chamber and the sound chamber, and evacuating the space between inner chamber and the outer chamber to having a gas pressure being lower than an ambient air pressure.

According to an exemplary embodiment of the method of testing microphones comprises the inner chamber an inner chamber opening, and an inner chamber door to open and close the inner chamber opening, wherein the inner chamber opening is adapted to receive the microphone to be tested in the open state of the inner chamber, and wherein the inner chamber door airtightly closes the inner chamber opening when testing.

According to an exemplary embodiment the method of testing microphones comprises:

providing the sound chamber comprising a first sound chamber half and a second sound chamber half, and opening the first sound chamber half and the second sound chamber half for providing a sound chamber opening placing the microphone to be tested through the sound chamber opening, and closing the first sound chamber half and the second sound chamber half to provide an electrical connection between the microphone to be tested and the test device.

The aspects defined above and further aspects of the pre-sent invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION OF EXEMPLARY EMBODIMENTS

Figure 1A:
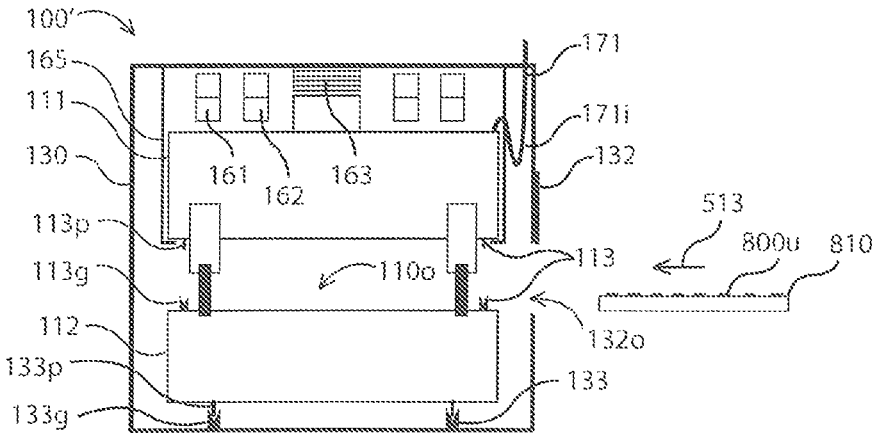
FIG. 1A shows a first embodiment of the microphone test module being open and empty

The illustrations in the drawings are schematically. It is noted that in different figures, similar or identical elements are provided with the same reference signs.

FIGS. 1A, B, C show a microphone test module 100'.

FIG. 1A shows in a first embodiment a cross-sectional view of a microphone test module 100' being open and empty with no carrier 810, included in the sound chamber 110. The microphone test module 100' comprises an outer chamber 130 having an outer chamber opening 132*o* through which a carrier 810 loaded with untested microphones 800*u* may be inserted by a carrier feed 513. The carrier 810 may be loaded with untested microphones 800*u* to be tested with the microphone test module 100'. The outer chamber 130 may further comprise an outer chamber door 132 which may be closed for testing. The outer chamber 130 may be airtight when the outer chamber door 132 is closed. Inside the outer chamber 130 may be a first sound chamber half 111 and a second sound chamber half 112 which may be mated in order to form a sound chamber 110. The second sound chamber half 112 may be aligned within the outer chamber 130 by a positioning device 133 comprising alignment pins 133*p* mounted to the second sound chamber half 112 and opposite alignment guides 133*g* being mounted to the bottom of the inner surface of the outer chamber 130. Thus, the second, or lower, sound chamber half 112 may be aligned with its alignment pins 133*p* on the alignment guides 133*g* inside the outer chamber 112.

The first sound chamber half 111 may be suspended to the inner top of the outer chamber 130 by at least one of the group of a ferromagnet 161, a diamagnet 162, an electromagnet 163, or an elastic suspension 165 in order to avoid transmission of structure-borne sound or any other mechanical vibration from the outer chamber 130 to the first, or upper sound chamber half 111. However, it may be necessary to provide at least one further suspension when using the ferromagnet 161, since it may be necessary to control and adjust the overall suspension force of the ferromagnet 161 on the first sound chamber half 111. The elastic suspension 165 may comprise an elastic rubber cord or any elastic material being suitable for elastically suspending the first sound chamber half 111 and eventually both, the first sound test chamber half 111 and the second sound test chamber half 112, mutually.

A supply cable 171 going through the outer chamber 130 may supply power and allow for a data exchange of the first sound chamber half 111 with the outside of the outer chamber 130. The supply cable 171 may form an inner loop 171*i* inside the outer chamber 130 for decoupling structure-borne sound from outside to the first sound test chamber half 111. The supply cable may alternatively or additionally form an outer loop 1710 for decoupling the first sound test chamber half 111 from the outside structure-borne sound (see FIG. 1C).

The first sound chamber half 111 and the second sound chamber half 112 may form a sound chamber opening 1100 on which the carrier 810 may be positioned for subsequent testing. Further, the first sound chamber half 111 may comprise alignment pins 113*p*, and the second sound chamber half 112 may comprise alignment guides 113*g*. When the first sound chamber half 111 and the second sound chamber half 112 are brought together the alignment pins 113*p* and the alignment guides 113*g* may form an alignment device 113, so that the first sound chamber half 111 and the second sound chamber half 112 are exactly aligned with each other.

Figure 1B:
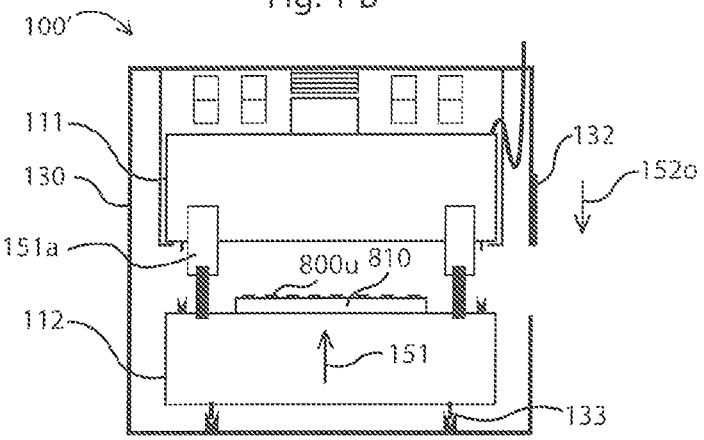
FIG. 1B shows a first embodiment of the microphone test module being open and including a carrier

FIG. 1B shows the first embodiment of the microphone test module 100' being open and including a carrier 810. FIG. 1B shows the carrier 810 being positioned between the first sound chamber half 111 and the second sound chamber half 112. Further, FIG. 1B indicates a mating direction 151 of the second, lower chamber half 112 towards the first sound chamber half 111. The mating movement may be provided by a first mating actuator in open position 151*a* being mounted between the first sound chamber half 111 and the second sound chamber half 112, and the sound chamber opening 1100 is open prior to the mating movement. The outer chamber door 132 may provide an outer closing movement 1520 in order to make the outer chamber 130 airtight.

Figure 1C:
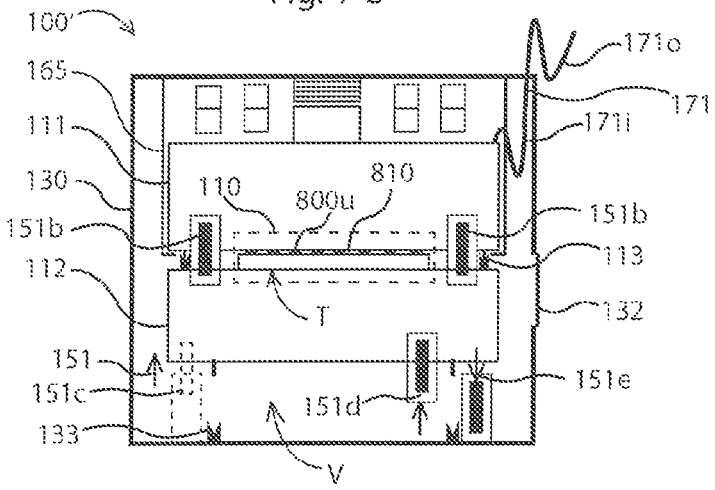
FIG. 1C shows a first embodiment of the microphone test module being closed and including a carrier

FIG. 1C shows the first embodiment of the microphone test module 100' being closed and including the carrier 810. FIG. 1C shows that a first mating actuator in closed position 151*b* so that the sound chamber 100 is formed and being airtight by mating and/or pressing the first sound chamber half 111 and the second sound chamber half 112 together. Alternatively, or additionally a second mating actuator in closing position 151*c* may first provide the mating movement and subsequently may be retracted towards the second chamber half 112, indicated with 151*d*, or may be retracted to the inner bottom of the outer chamber 130, indicated with 151*e*.

When the first sound chamber half 111 and the second sound chamber half 112 are brought together, the sound chamber 110 in between the both may be airtight and may provide an appropriate sound chamber pressure T inside the sound chamber 110. The first sound chamber half 111 and the second sound chamber half 112 may be mutually suspended to the inner top of the outer chamber 130 by avoiding the structure-borne sound to transfer from the outside to the sound chamber 110. Additionally, a vacuum space between the outer chamber 130 and the mated first and second sound chamber halves 111, 112 may be evacuated to a certain vacuum pressure V.

Figure 2A:
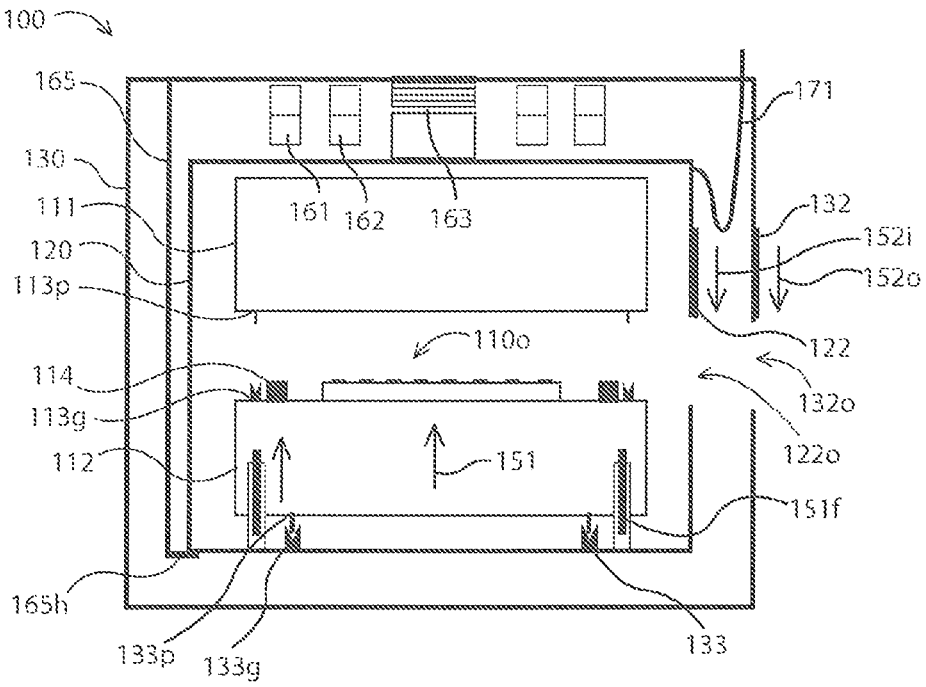
FIG. 2A shows an open microphone test module comprising an inner chamber, and including a carrier
Figure 2B:
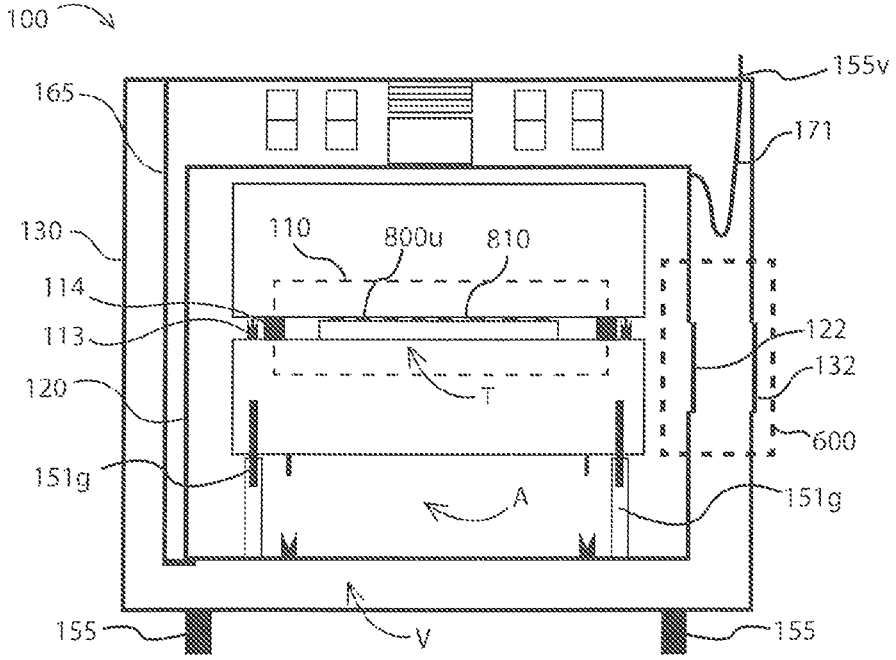
FIG. 2B shows a closed microphone test module comprising an inner chamber, and including a carrier

FIG. 2A and FIG. 2B show another embodiment of a microphone test module 100 which is largely similar to the microphone test module 100' shown in FIG. 1A to FIG. 1C, so that primarily the differences are explained in more detail.

FIG. 2A shows the microphone test module 100 in an open state, and FIG. 2B shows the microphone test module 100 in a closed state, where a test may be executed. The microphone test module 100 may additionally comprise an inner chamber 120 between the outer chamber 130 and the sound chamber 110, or first and second sound chamber halves 111, 112, respectively. As a consequence, the inner chamber 120 is suspended to the inner top of the outer chamber 130. At least one or more suspension hooks 165*h* at the end of the suspension 165 may support the inner chamber 120 directly from the outside on the bottom of the inner chamber 120 so that structure-borne sound travels a long distance from the top of the outer chamber 130 to the outer bottom of the inner chamber 120 and may be therefore suppressed. The inner chamber 120 comprises an inner chamber opening 122*o* and is equipped with an inner chamber door 122 closing with an inner closing movement 152*i* for providing an airtightness when testing. The positioning device 133 and the third mating actuator 151*f* may both be supported from the inner bottom of the inner chamber 120. In particular, the third mating actuator may rest in the closing position 151*g* and may support pressing the first, and second sound chamber halves 111, 112 together, since the inner chamber 120 is already soundproof against the outside of the outer chamber 130. A sealing ring 114 may additionally provide airtightness between the sound chamber 110 and the inner space of the inner chamber 120. The outer chamber 130 may have spring-loaded feet 155, or air-sprung feet 155 for further suppressing outside generated air-borne sound. However, the supply cable 171 may still go through the outer chamber 130 at a certain point 155*v* and may provide airtightness there, as well.

A vacuum space with vacuum pressure V is now formed between the outer chamber 130 and the inner chamber 120, so that the sound chamber pressure T may be more stable, since inside the inner chamber the pressure may be close to or correspond ambient pressure A.

Figure 3:
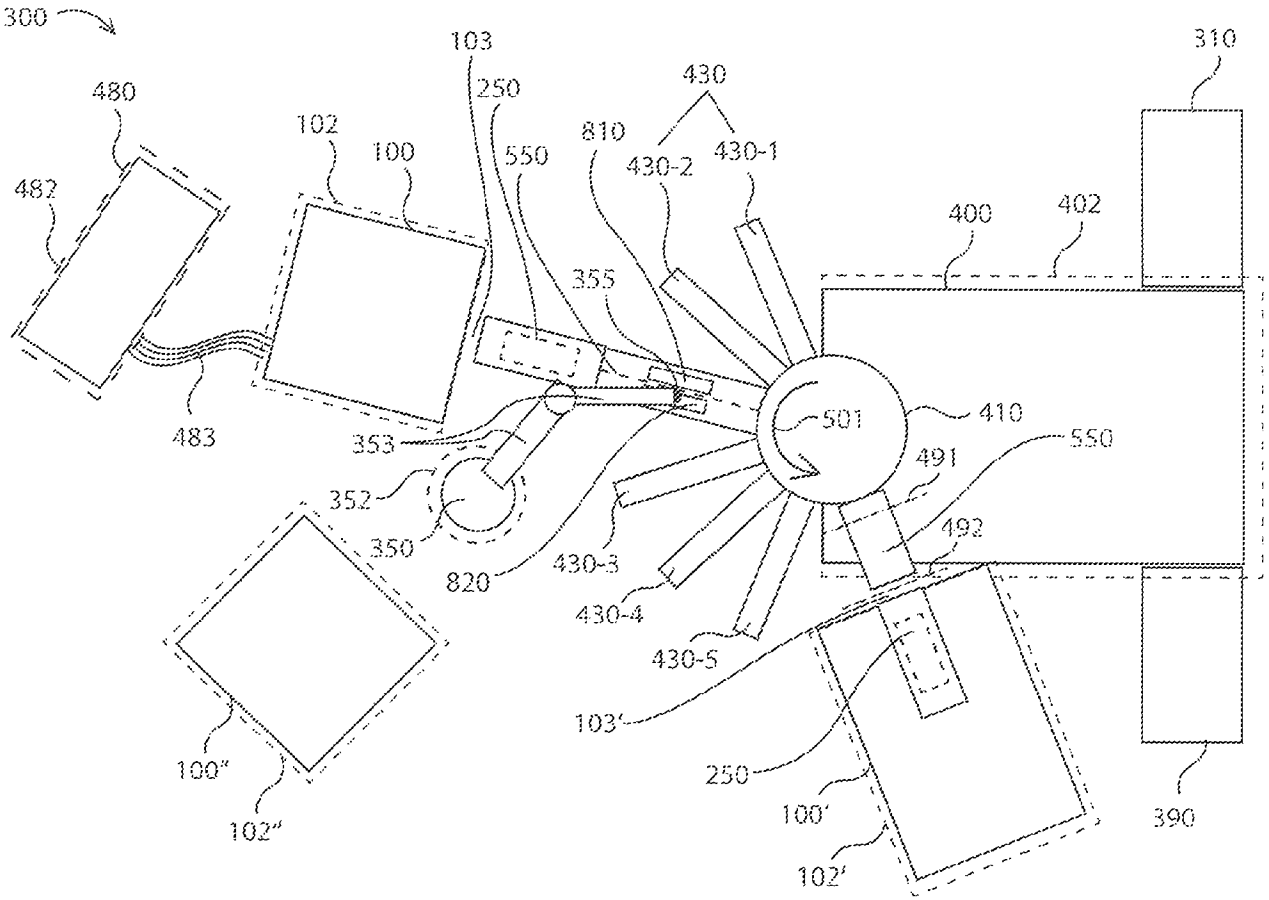
FIG. 3 shows an automated test equipment including three microphone test modules

FIG. 3 shows an automated test equipment 300 for testing microphones including three microphone test modules 100, 100', 100". The automated test equipment 300 comprises a tester 480, and a handler 400 comprising a plurality of processing stations 430-1 to 430-5, or named "processing station" 430, in general. The automated test equipment 300 may, in particular, provide one, two, or three microphone test modules 100, 100', 100" for testing microphones.

The handler 400 further comprises a component loader 310 for loading the untested electronic components and a component unloader 310 for unloading the tested electronic components, in particular, the microphones. The handler 400 is designed as a turret handler comprising a rotary table 410 having a specific direction of rotation 501. Around the rotary table different processing stations 430-1 to 430-5 provide a plurality of procedures for electronic component backend treating. The handler 400 with the rotary table 410 may also be called "turret handler".

Around and adjacent to the rotary table 410 the carrier 400 may comprise a carrier station 550. The handler 400 may place singulated electronic components on a first carrier 810 and/or on a second carrier 820. The carriers 810, 820 may be further passed to a sound test module 100 in a more known way linearly by a carrier exchange section 250 towards the sound test module 100 or the carriers 810, 820 may be transferred from the carrier station 550 to the sound test module 100 by a robot 350. For this reason, the robot 350 may comprise a freely, 3-dimensionally moveable arm 353 comprising a rotatable gripper 355 so that the robot 350 may take up the carriers 810, 820 in different positions and may drop the carriers 810, 820 on different locations and in different orientations of the carriers 810, 820. The robot 350 may position the carriers 810, 820 inside the sound test modules 100, 100" or on the carrier exchange section 250 of the sound test module 100.

There may be a gap or air gap 103 between the microphone test module 100 and the carrier exchange section 250, so that structure-borne sound may be prohibited to travel towards the microphone test module 100. The tester 480 may be connected with the sound test module 100 by a cable 483.

The further sound test module 100' may be coupled towards the handler 400 in a different way such that there is still an air gap 103' between the handler and the sound test module 100', but the sound test module 101' may be provided with the carriers 810, 820 directly from the carrier station 550. Therefore, the carrier exchange section 250 may be partially or completely arranged inside the sound test module 100'.

However, any of the group of the handler 400, the robot 350, the microphone test modules 100, 100", the further microphone test module 100', and the tester 480 may each have its own footprint on the test floor, so that the handler footprint 402, the robot footprint 352, the microphone test module footprints 102, 102', 102", and the tester footprint 482 differ from each other. This may emphasize that components of the automated test equipment 300 may be exchanged easily and that a microphone test may be executed with the microphone test module 100 and with the further microphone test module 100', or the third microphone test module 100" while a structure-borne sound is suppressed and test conditions for the microphone test are amended. The exchangeability may further be indicated with the module boundary 492 being equal with the air gap 103'.

Moreover, a carrier station boundary 491 depicts a transition from the handler 400 towards the carrier station 550 which may also be an exchangeable module depending on the used carriers 810, 820 which may vary, e.g. if a tested MEMS microphone is of a so called top-port or bottom-port type.

Figure 4:
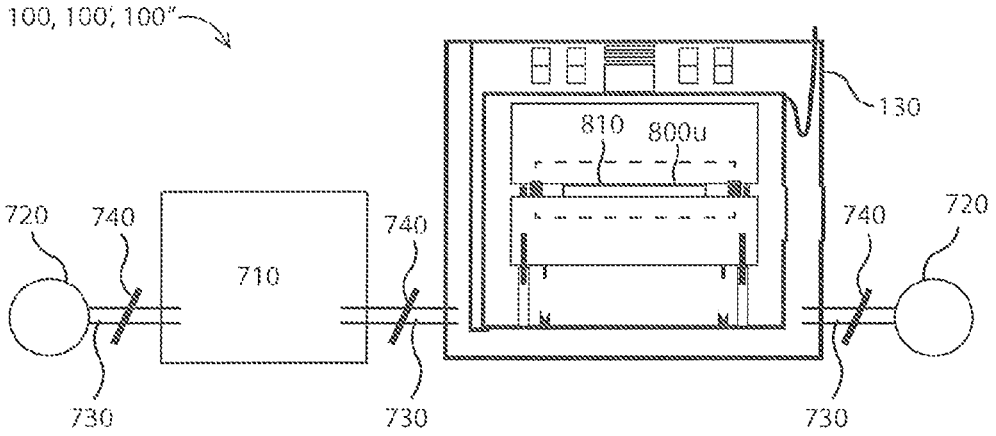
FIG. 4 shows an embodiment of the microphone test module comprising a vacuum reservoir

FIG. 4 shows an embodiment of the microphone test module 100, 100', 100" comprising a vacuum reservoir. FIG. 4 shows microphone test module 100, 100', 100" for testing microphones in an embodiment including a vacuum supply for evacuating the outer chamber 130. A vacuum pump 720 may be connected with the outer chamber 130 by a vacuum hose 730 or vacuum tube 730. A vacuum valve 740 may close when the right amount of vacuum is reached and may open to let air into the outer chamber 130 when the test stops and/or the carrier 810 shall be replaced.

In a further embodiment a vacuum reservoir 710 is located and connected between the outer chamber 130 and the vacuum pump 720. To each side of the vacuum reservoir 710 a vacuum valve 740 may be connected towards the vacuum pump 720 and/or to the outer chamber 130, respectively. If vacuum shall be applied as quick as possible, the vacuum valve 740 between the vacuum reservoir 710 and the outer chamber 130 may be opened, so that a defined vacuum is applied to the inside of the outer chamber 130. Then the pressure in the vacuum reservoir 710 and outer chamber 130 reaches a balanced state. To reach a certain vacuum pressure inside the outer chamber 130 the vacuum reservoir 710 may therefore previously be evacuated by the vacuum pump 720 to a certain vacuum pressure. The vacuum reservoir 710 may have a sufficient volume in order to achieve a specific vacuum pressure inside the outer chamber 130.

Figure 5:
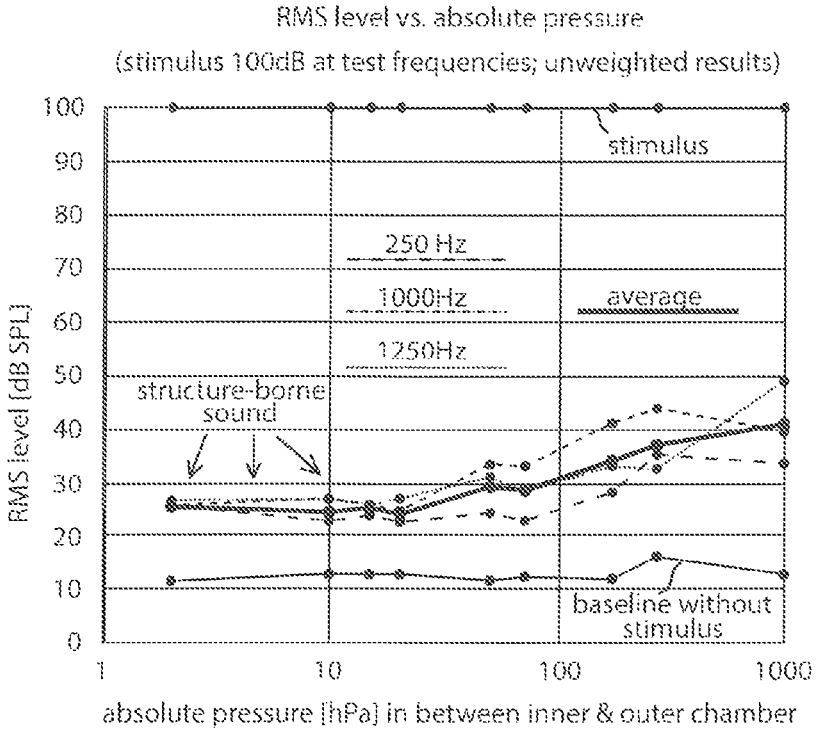
FIG. 5 shows a graph about measurements with a setup resembling a microphone test module

FIG. 5 shows a graph about measurements and/or findings with a setup resembling a microphone test module 100, 100', 100" according to one of the embodiments described in FIG. 1A to 2B. FIG. 5 shows a graph where a measured RMS level [dB SPL] is shown on the vertical axis while an absolute pressure difference [hPa] between an inner chamber (120, see FIGS. 1,2) and an outer chamber (130, see FIGS. 1,2) is shown on the horizontal axis. A measurement for three different frequencies of 250 Hz, 1000 Hz, or 1250 Hz results in the marked graphs. An average graph for these three graphs according to the three frequencies is marked with a thicker line. The graphs according to the three different frequencies lie completely in the range between the stimulus defined at 100 dB SPL with a reference microphone and a baseline without a stimulus. The result shows a decent decay of the RMS level according with a higher evacuation, i.e. with a lower absolute pressure of the space between the inner and the outer chamber. However, the decay stays at a value of 20-30 RMS level dB SPL when approaching 10 hPa. This remaining residue may originate from structure-borne sound since the inner chamber and the outer chamber were not sufficiently separated from each other against structure-bore sound for the purpose of this measurement. However, this will leave it open that with suppression of structure-borne sound the soundproofing between the two chambers may be even better than with an applied vacuum alone.

Figure 6A:
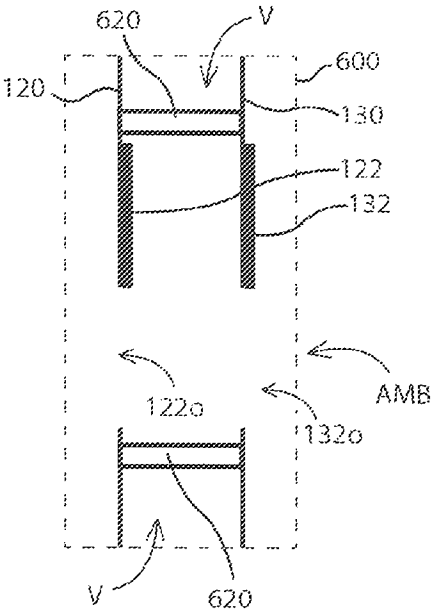
FIG. 6A shows an open airlock between an outer chamber and an inner chamber

FIG. 6A shows an open airlock 600 between an outer chamber 130 and an inner chamber 120, comprising an outer chamber door 132 being open and an inner chamber door 122 being open. A sealing ring 620 may be fixedly mounted to the inner chamber 120 and the sealing ring 620 may form an airtight sealing with the outer chamber 130, so that the vacuum V in the space between the inner chamber 120 and the outer chamber 130 is maintained. Ambient air AMB may flow through the outer chamber opening 132*o* and through the inner chamber opening 122*o* into the inner chamber 120. Then the microphone 800*u* to be tested may be inserted through the outer chamber opening 132*o* and through the inner chamber opening 122*o* (see FIG. 2A, B).

Figure 6B:
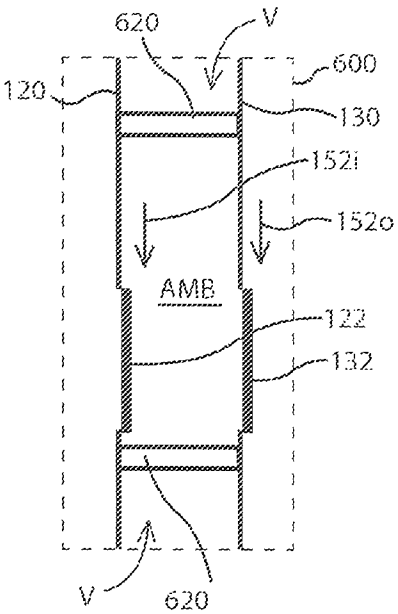
FIG. 6B shows an airlock with closed inner and outer chamber doors

FIG. 6B shows that with a closing movement 152*o* of the outer chamber door 132, the outer chamber 130 becomes airtight and with a closing movement 152*i* of the inner chamber door 122, the inner chamber 120 becomes airtight. A space within the airlock 600 may be filled with ambient air AMB having ambient air pressure. However, the free space between the inner chamber 120 and the outer chamber 130 may still have a vacuum pressure V.

Figure 6C:
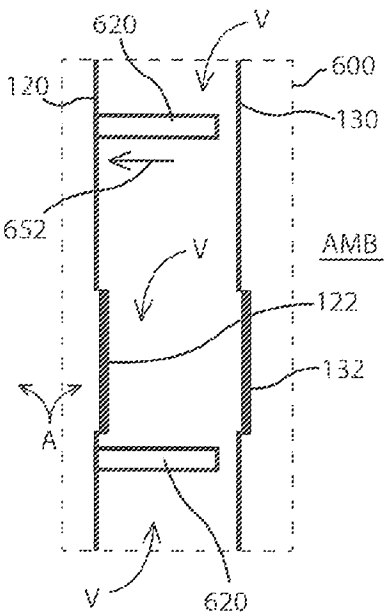
FIG. 6C shows a closed airlock with an inner chamber undocked from an outer chamber

FIG. 6C shows that the inner chamber 120 and the outer chamber 130 are removed from each other with a undocking movement 652, so that an even pressure between space within the airlock 600 and the free space between the outer chamber 130 and the inner chamber 120 is established. It may be possible to build the airlock 600 in different embodiments including a self-locking mechanism, and any other mechanism known with airlocks. As a consequence of using an airlock 600 a space for being evacuated may be much smaller than a space without using the airlock 600, since in the latter case also the free space between the inner chamber and the outer chamber must be evacuated. This may cost more energy and, in particular time. An air pressure A inside the inner chamber may similar to the ambient air pressure AMB. However, with the vacuum pressure V between the outer chamber 130 and the inner chamber 120, the inner chamber 120 and, in particular, the sound chamber 110 (see FIG. 2A, B) may be decoupled from noise outside the outer chamber 130.

For establishing the airlock 600 the procedure described with FIG. 6A to FIG. 6C may be reversed: The inner chamber 120 may move towards the outer chamber 130, so that the sealing ring 620 forms the airlock 600, so that the microphone may be taken back out through the opened inner camber opening 122*o* and through the opened outer chamber opening 132*o* after the inner chamber door 122 and the outer chamber door 132 were opened.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A microphone test module for testing a microphone in the area of semiconductor testing comprises:

an outer chamber being airtight, and a sound chamber comprising an electrical test device for testing the microphone, wherein the electrical test device comprises a test socket for semiconductor testing arranged within the sound chamber and configured to apply test signals to the microphone and to transmit data and the test signals to a tester being located outside of the outer chamber, wherein the sound chamber is located within the outer chamber, and wherein the sound chamber is coupled to the outer chamber with a connection suppressing structure-borne noise between the outer chamber and the sound chamber, wherein a space between the outer chamber and the sound chamber has a gas pressure being lower than an ambient air pressure, wherein the sound chamber comprises a first sound chamber half and a second sound chamber half, wherein the first sound chamber half and the second sound chamber half provide a sound chamber opening to receive the microphone to be tested, and wherein the first sound chamber half and the second sound chamber half provide an electrical connection between the microphone to be tested and the test device, a first mating actuator being mounted between the first sound chamber half and the second sound chamber half for providing a mating movement in open position and a closed position so that the sound chamber is formed and being airtight by mating the first sound chamber half and the second sound chamber half together.

2. The microphone test module according to claim 1, wherein the outer chamber comprises an outer chamber opening, and an outer chamber door to open and close the outer chamber opening, wherein the outer chamber opening is adapted to receive the microphone to be tested in the open state of the outer chamber, and wherein the outer chamber door airtightly closes the outer chamber opening when testing.

3. The microphone test module according to claim 1, wherein the connection for suppressing the structure-borne noise comprises a suspension being elastic and/or a support being elastic, and wherein the elasticity is achieved by a magnetic field and/or an elastic material.

4. The microphone test module according to claim 1, further comprising:

a vacuum pump to evacuate the space within the outer chamber by directly connecting to the outer chamber and/or indirectly by connecting to a vacuum reservoir being connected to the outer chamber via a closed valve, wherein the vacuum pump precedingly evacuates the vacuum reservoir before the valve opens for evacuating the space within the outer chamber.

5. The microphone test module according to claim 1, further comprising a supply cable for supply of electrical power and/or data transfer, wherein the supply cable goes airtightly through the outer chamber and connects to the microphone when testing.

6. The microphone test module according to claim 1, further comprising an inner chamber, wherein the inner chamber is located inside the outer chamber, and wherein the sound chamber is located inside the inner chamber, the inner chamber being airtight when testing, wherein the inner chamber is coupled to the outer chamber with the connection suppressing structure-borne noise between the outer chamber and the inner chamber, so that structure-borne noise is suppressed between the outer chamber and the sound chamber, and wherein a space between inner chamber and the outer chamber has the gas pressure being lower than an ambient air pressure.

7. The microphone test module according to claim 6, wherein the inner chamber comprises an inner chamber opening, and an inner chamber door to open and close the inner chamber opening, wherein the inner chamber opening is adapted to receive the microphone to be tested in the open state of the inner chamber, and wherein the inner chamber door airtightly closes the inner chamber opening when testing.

8. An automated test system for testing microphones comprising a handler and a microphone test module according to the claim 1, wherein the handler is adapted to feed microphones to be tested to the test module.

9. The automated test system according to claim 8, further comprising a carrier for carrying the microphones, wherein the handler feeds the carrier carrying the microphones to be tested to the test module.

10. A method of semiconductor testing microphones comprises:

providing an outer chamber being airtight, and providing a sound chamber comprising an electrical test device for testing the microphone, wherein the electrical test device comprises a test socket for semiconductor testing arranged within the sound chamber and configured to apply test signals to the microphone and to transmit data and the test signals to a tester being located outside of the outer chamber, wherein the sound chamber is located within the outer chamber, and wherein the sound chamber is coupled to the outer chamber with a connection suppressing structure-borne noise between the outer chamber and the sound chamber, wherein the sound chamber comprises a first sound chamber half and a second sound chamber half, wherein the first sound chamber half and the second sound chamber half provide a sound chamber opening to receive the microphone to be tested, and wherein the first sound chamber half and the second sound chamber half provide an electrical connection between the microphone to be tested and the test device, a first mating actuator being mounted between the first sound chamber half and the second sound chamber half for providing a mating movement in open position and a closed position so that the sound chamber is formed and being airtight by mating the first sound chamber half and the second sound chamber half together, and evacuating a space between the outer chamber and the sound chamber to having a lower gas pressure than an ambient air pressure, and testing the microphone.

11. The method of testing microphones according to claim 10 further comprises:

providing the outer chamber with an outer chamber opening having an outer chamber door, and opening the outer chamber door to receive the microphone to be tested in the outer chamber, closing the outer chamber door airtightly when testing the received microphone.

12. The method of testing microphones according to claim 10 further comprises:

providing a vacuum pump to evacuate the space within the outer chamber by directly connecting the vacuum pump to the outer chamber and evacuating the space within the outer chamber by using the vacuum pump and/or providing a vacuum pump to evacuate the space within the outer chamber indirectly by connecting the vacuum pump to a vacuum reservoir being connected to the outer chamber via a closed valve, and evacuating the vacuum reservoir using the vacuum pump to generate a vacuum in the vacuum reservoir, and opening the valve to evacuate the space within the outer chamber with the generated vacuum.

13. The method of testing microphones according to claim 10 further comprises:

providing an inner chamber being airtight, wherein the inner chamber is located inside the outer chamber, and wherein the sound chamber is located inside the inner chamber, wherein the inner chamber is coupled to the outer chamber with the connection suppressing structure-borne noise between the outer chamber and the inner chamber, so that structure-borne noise is suppressed between the outer chamber and the sound chamber, and evacuating the space between inner chamber and the outer chamber to having a gas pressure being lower than an ambient air pressure.

14. The method of testing microphones according to claim 10 further comprises:

opening the first sound chamber half and the second sound chamber half for providing the sound chamber opening, placing the microphone to be tested through the sound chamber opening, and closing the first sound chamber half and the second sound chamber half to provide an electrical connection between the microphone to be tested and the test device.

* * * * *